US012012177B2

(12) United States Patent
Hunt et al.

(10) Patent No.: US 12,012,177 B2
(45) Date of Patent: Jun. 18, 2024

(54) FIXATION DEVICE AND INSTALLATION METHOD

(71) Applicant: SCHOTTEL Marine Technologies GmbH, Spay (DE)

(72) Inventors: Andrew Hunt, Edinburgh (GB); Nicholas Cresswell, Edinburgh (GB)

(73) Assignee: SCHOTTEL MARINE TECHNOLOGIES GMBH, Spay (DE)

( * ) Notice: Subject to any disclaimer, the term of this patent is extended or adjusted under 35 U.S.C. 154(b) by 280 days.

(21) Appl. No.: 17/634,167

(22) PCT Filed: Aug. 11, 2020

(86) PCT No.: PCT/GB2020/051911

§ 371 (c)(1),
(2) Date: Feb. 9, 2022

(87) PCT Pub. No.: WO2021/028676

PCT Pub. Date: Feb. 18, 2021

(65) Prior Publication Data

US 2022/0315169 A1 Oct. 6, 2022

(30) Foreign Application Priority Data

Aug. 12, 2019 (GB) ..... 1911535
Aug. 12, 2019 (GB) ..... 1911538

(51) Int. Cl.
*B63B 21/26* (2006.01)
*E02D 5/80* (2006.01)

(52) U.S. Cl.
CPC ..... *B63B 21/26* (2013.01); *E02D 5/801* (2013.01); *E02D 2600/30* (2013.01)

(58) Field of Classification Search
CPC ..... B63B 21/26; E02D 5/801; E02D 2600/30
See application file for complete search history.

(56) References Cited

U.S. PATENT DOCUMENTS 4,312,289 A * 1/1982 Conrad ..... B63B 21/26 114/305
5,114,276 A * 5/1992 Dupin ..... B63B 21/502 114/294

(Continued)

FOREIGN PATENT DOCUMENTS

CN 106005262 A * 10/2016 ..... B63B 21/20
CN 107933830 A * 4/2018 ..... B63B 21/26

(Continued)

OTHER PUBLICATIONS

Combined Search and Examination Report dated Feb. 6, 2020 from related GB Application No. GB1911535.1, 5 pages.

(Continued)

*Primary Examiner* — Frederick L Lagman
(74) *Attorney, Agent, or Firm* — INNOVATION CAPITAL LAW GROUP, LLP; Vic Lin

(57) ABSTRACT

The invention relates to an elongate fixation device (1) for use in subsea anchoring, and a method for installation. The device (1) has a triple nested stem arrangement, the innermost stem (2) of which has a cutter (9) disposed at a distal end and a tapered section (8) located adjacent to and proximally behind the cutter (9). An intermediate stem (3) surrounds at least a central portion of the inner stem (2) and has one or more flareable cutting fingers (7) at its distal end. An outer stem (4) surrounds a proximal portion of the intermediate stem (3). The inner (2) and intermediate (3) stems are coupled by a first releasable coupling (17) which when released allows relative axial motion along a first distance. The outer and intermediate stems are coupled by a second releasable coupling (18) which when released allows relative axial motion along a second distance. The intermediate stem 3 is nested within the outer stem (4), in some cases for at least a majority of the outer stem (4). In some examples, the outer stem (4) has a rotationally driveable (Continued)

portion 10 and the inner stem 2 has a tensioning nut (12) for adjusting the relative axial positions of the inner (2) and outer 4 stems. The tensioning nut (12) and the driveable portion (10) are coupleable to a single rotational drive (23). The invention also relates a method for installation and to installation apparatus (21).

20 Claims, 5 Drawing Sheets

(56) References Cited

U.S. PATENT DOCUMENTS

| | | | | |
|---|---|---|---|---|
| 5,460,231 | A | 10/1995 | Collins | |
| 6,223,671 | B1 * | 5/2001 | Head | E02D 5/805 114/295 |
| 10,119,237 | B2 * | 11/2018 | Vasey | B63B 21/26 |

FOREIGN PATENT DOCUMENTS

| | | | | | |
|---|---|---|---|---|---|
| CN | 112092979 | B | * | 7/2021 | B63B 21/26 |
| CN | 113978620 | A | * | 1/2022 | |
| CN | 113998056 | A | * | 2/2022 | |
| EP | 1783379 | A1 | | 5/2007 | |
| GB | 2513942 | A | * | 11/2014 | B63B 21/26 |
| GB | 2536372 | A | | 9/2016 | |
| WO | 2016092322 | A1 | | 6/2016 | |

OTHER PUBLICATIONS

International Search Report & Written Opinion dated Nov. 6, 2020 from corresponding PCT Application No. PCT/GB2020/051911, 11 pages.

* cited by examiner

FIXATION DEVICE AND INSTALLATION METHOD

This invention relates to fixation devices and in particular to fixation devices for us in an underwater environment, for example for anchoring floating devices such as water- or wind-powered turbines, ships, rigs, floating production and storage facilities, aquaculture farms, etc. to a water bed.

Many designs of anchoring system are known and in use today. This invention focuses on undercut anchoring piles. An example of an undercut anchoring pile is described in GB 2536372, from which FIG. 1 of the present application is taken to illustrate the features of the prior art.

FIG. 1 shows the anchor pile in an intermediate stage of installation. A pilot hole has been drilled into a substrate, with the level of the substrate indicated by the line although neither the bulk of the substrate nor the drilled hole is shown. The structure of the anchor pile includes an elongate shaft 62 carrying a drill bit 64 located at a distal end. A guide body 66 is provided in association with the shaft 62 behind the drill bit 64.

The inner shaft is enclosed by an outer shaft, formed in two cooperating parts: a cylindrical lower casing part 73 provided at a distal end with cutting fingers 80; and an upper part 88, which is provided with a torque linkage to the lower part 73 by means of the breakable torque connection shown generally as 84 and in more detail in the middle of the three insets. The cutting fingers articulate about the lower part of the sleeve by means of pivots 86. The inner diameter of the two parts of the outer shaft 73, 88 is equal, and each slots neatly over the inner shaft 62 which has an outer diameter approximately the same as the inner diameter of the outer shaft 73, 88.

The two parts of the outer shaft 88, 73 have different roles, and the join between them emphasises this functionality. The upper part 88 is tapered to bear on the substrate and to close the gap created around the anchor by the drilling process as described in more detail below. This upper part 88 is separated from, but rotationally and axially coupled to, the lower part 73, which is used to cut an undercut. The junction 84 between these two parts 73, 88 is located approximately halfway along the length of the outer sleeve, leaving the upper part to taper smoothly to the junction, being long enough to fulfil its function, but leaving enough space at the lower end for the lower part 73 to operate as intended.

In a first phase of drilling a hole, a rotational drive is imparted to the shaft 62, either independently of the sleeve casing or in a coupled manner in the sense that the entire arrangement is rotationally driven. Independent driving is significantly more complex and requires at least that the initial drilling rig be decoupled and a separate rig attached to drill in the uppermost section. This has the effect of rotatably driving the shaft about its longitudinal axis to effect a cutting action via the drill bit 64 and drive the device distally into the substrate through the hole thereby drilled in the substrate.

In the intermediate installation step shown, the sleeve arrangement 73, 88 is rotatably decoupled from and driven separately from the shaft 62. The sleeve 73, 88 is pushed downwards (further into the substrate) over the guide body 66 to spread the fingers 80 (pivoting via pivots 86 and drill a reverse tapered undercut into the bottom of the hole. The fingers 80 and tapered guide body 66 then engage into the reverse taped undercut to fix the device in place.

In the example disclosed in GB 2536372 a bayonet drive 95 is provided for the outer sleeve 73, 88 and a hex drive for the inner shaft, where the inner shaft is driven by a threaded rod and a special interface piece for forming a connection between the threaded end of the inner stem and the drill head. This is to allow disengagement of respective drives for each shaft from the device without having to prevent rotational movement of either the inner shaft or outer sleeve as would be the case if the connections were threaded for example. This is achieved by breaking the connection once the anchor is tensioned. The bayonet connection to the outer sleeve in particular is provided to allow easy connection for withdrawal of the anchor/pile device from the substrate after use.

Once the fingers 80 are deployed into position within the reverse tapered undercut as an anchor, a pre-tensioning is introduced into the shaft to enable it to function as a pile tendon. This is done by means of the tensioning nut 92 mounted on a proximal end 91*a* of the inner shaft 62.

The collapsible torque connection 84 is shown in more detail in the middle inset. It comprises an internally splined compression sleeve 99 on the upper part 88 of the sleeve, an externally splined compression sleeve 102 on the lower part of the sleeve 73, and two shear pins 100 coupling the splined connections together.

This coupling serves as a spacer part between the upper part 88 and lower part 73 of the sleeve. The spline transmits rotational drive and drilling thrust between the two parts 73, 88. In the final phase of deployment, as tension is progressively introduced into the shaft 62 via the tensioning nut 92, a compressive load is generated across this linkage, and eventually the shear pins 100 fail at a predetermined compressive load, the two compression sleeves 99, 102 telescope one inside the other, and the axial spacing between the two parts 88 and 73 collapses. The anchor pile is wedged into the substrate between the taper of the upper part of the sleeve 88 and the combination of the fingers 80 with the guide body 66, held under tension of the inner stem 62 (tensioned by the tensioning nut 92).

The inventors of the present invention have noted some design drawbacks with this prior art arrangement such as difficulties in installation and removal processes; problems with resistance to lateral loading; and complexity and expense of manufacturing. The present invention aims to address some or all of these drawbacks.

A first example disclosed herein is an elongate fixation device for use in subsea anchoring, the fixation device comprising: an inner stem having a cutter disposed at a distal end and a tapered section located adjacent to and proximally of the cutter; an intermediate stem having a generally tubular shape and being shorter than the inner stem, the intermediate stem surrounding a central portion of the inner stem and extending distally towards the taper section, wherein the intermediate stem has one or more flareable cutting fingers at its distal end; and an outer stem having a generally tubular shape and a portion for retaining the fixation device in a substrate, the outer stem further having a third length in an axial direction less than the first length, the outer stem surrounding a proximal portion of the intermediate stem and extending proximally beyond a proximal end of the intermediate stem; a first releasable coupling between the inner and intermediate stems; and a second releasable coupling between the outer and intermediate stems; wherein the inner, intermediate and outer stems are rotationally coupled to one another; wherein the first releasable coupling has a coupled configuration in which relative axial motion between the inner and intermediate stems is prevented and an uncoupled configuration in which relative axial motion between the inner and intermediate stems along a first distance is possible; wherein the second releasable coupling has a coupled configuration in which relative axial motion between the intermediate and outer stems is prevented and an uncoupled configuration in which relative axial motion between the intermediate and outer stems along a second distance is possible; wherein the outer stem has a driving portion for coupling to a rotational drive and the inner stem has a tensioning nut located proximally of the driving portion for adjusting the relative axial positions of the inner and outer stems, the tensioning nut being located on the inner stem and adjustable by coupling to a rotational drive; and wherein the tensioning nut and the driving portion are configured to couple to the same rotational drive.

That is to say, each of the driving portion and the hex nut can be driven by the same rotational torque to actuate them. The outer stem has a profile for being gripped by a rotational device to rotate the device (that is, to rotate the entire device, due to the rotational coupling between the stems) to drill into the sea bed. The tensioning nut is moveable under a rotational action along the inner stem (which can be threaded at its proximal end to permit this motion), where it bears against the protruding part of the outer stem and forces relative movement to grip the rock.

The use of a single drive for this purpose vastly simplifies the installation procedure. Compare with the prior art device described above which uses separate drives for the tensioning and drilling phases. An example of a suitable coupling is a hex drive system, as this allows the couplings to be coupled/decoupled from the drive with a simple axial motion. Of course other shapes and types of drive are also possible.

In other examples, a hex nut is not essential, and a square, triangular, etc. profiled coupling may be used. Indeed any regular polygon is possible. The greater the number of faces, the less purchase is possible for driving the profile (as the limiting case is a circle). Conversely, fewer faces leads to problems forming the driving portion from an outer stem, as the wall thickness of the outer stem limits the shape which can be formed because smaller numbers of faces deviate too much from a circle to allow it to be easily milled from a relatively thin wall thickness. For these reasons, the hex profile is preferred because it balances these two conflicting pressures, but the skilled person will appreciate that the fixation device disclosed herein would work with driving portion having any profile so long as it matches the profile of the tensioning nut.

As will be clear in the foregoing, the intermediate stem may be nested within the outer stem for at least a majority of the outer stem. A way to achieve this feature is to arrange a smallest inner diameter of the outer stem to be larger than a largest outer diameter of the intermediate stem. That is to say, that the outer stem contains, for most of its length, a part of the intermediate stem. For example, the intermediate stem can extend out of an end of the outer stem, meaning that parts of the intermediate stem are not covered by the outer stem, but for most or all of the length of the outer stem, portions of the intermediate stem are located inside a hollow part of the tubular outer stem. A majority of the outer stem in this case means at least half, but may include the entire outer stem.

Optionally, the driving portion is spaced in a distal direction from the proximal end of the outer stem. This provides some tolerance in the dual drive ability, in the sense that the tensioning nut can be fully retained in the hex drive, while the driving portion is released. The gap allows there to be a region in which the end of the hex drive is clear of the driving portion but still overlaps a part of the outer stem, thus ensuring that the tensioning nut is definitely still retained.

Optionally the proximal end of the outer stem is narrower than the driving portion. This ensures that the outer stem is not driven by (and indeed does not interact with at all) the hex drive when the driving portion has been disengaged.

A second example disclosed herein is an elongate fixation device for use in subsea anchoring, the device comprising: an inner stem having a first length in an axial direction, the inner stem having a cutter disposed at a distal end and a tapered section located adjacent to and proximally of the cutter; an intermediate stem having a generally tubular shape and having a second length in an axial direction less than the first length, the intermediate stem surrounding at least a central portion of the inner stem and extending distally towards the taper section, wherein the intermediate stem has one or more flareable cutting fingers at its distal end; an outer stem having a generally tubular shape and a portion for retaining the fixation device in a substrate, the outer stem further having a third length in an axial direction less than the first length, the outer stem surrounding a proximal portion of the intermediate stem and extending proximally beyond a proximal end of the intermediate stem; a first releasable coupling between the inner and intermediate stems; and a second releasable coupling between the outer and intermediate stems; wherein the first releasable coupling has a coupled configuration in which relative axial motion between the inner and intermediate stems is prevented and an uncoupled configuration in which relative axial motion between the inner and intermediate stems along a first distance is possible; wherein the second releasable coupling has a coupled configuration in which relative axial motion between the intermediate and outer stems is prevented and an uncoupled configuration in which relative axial motion between the intermediate and outer stems along a second distance is possible; and wherein the intermediate stem is nested within the outer stem for at least a majority of the outer stem. In other words a majority of the outer stem overlaps parts of the intermediate stem. A way to achieve this latter feature is to arrange a smallest inner diameter of the outer stem to be larger than a largest outer diameter of the intermediate stem. That is to say, that the outer stem contains, for most of its length, a part of the intermediate stem. For example, the intermediate stem can extend out of an end of the outer stem, meaning that parts of the intermediate stem are not covered by the outer stem, but for most or all of the length of the outer stem, portions of the intermediate stem are located inside a hollow part of the tubular outer stem. A majority of the outer stem in this case means at least half, but may include the entire outer stem. As noted above, this is an arrangement applicable to the second example, and in some cases, the first example too. The foregoing description of optional features and their advantages therefore applies equally to the first and second examples.

By arranging the overlap of the stems in the manner described, the outer stem can extend over and along the intermediate stem for a much greater distance than in prior art designs, even up to substantially the entire length of the outer stem, leading to a triply nested stem arrangement (as the inner stem typically runs for substantially the entire length of the device). Equally, where the smallest inner diameter of the outer stem is larger than the largest outer diameter of the intermediate stem, the range of potential relative axial motion between the outer and intermediate stems is increased. This brings further advantages in terms of structural strength.

From pile theory, when a pile anchor is installed in a substrate, as illustrated in the Figures, the anchor pivots about a point below the substrate taper towards the base of the anchor, part way along. In the prior art device described above, the pivoting point (i.e. the location of maximum strain due to flexing or bending caused by lateral loading) occurs in proximity to, the collapsible coupling. This pivoting causes the bending moment distribution on the anchor structure to peak close to the collapsible coupling, meaning that a weak point here is a potential failure mechanism for the anchor. By providing the triple concentric stem arrangement, the intermediate and outer stems have a larger range of overlap, which inherently increases strength.

Moreover, the large range of overlap means that any couplings for transferring axial or rotational motion can be made at any point along the length of overlap, thereby allowing these connections to be made at locations other than the maximum point of strain and bending. The range of allowable motion (along the first and second distances) is not limited by the amount of overlap (compare this with the situation in GB 2536372 where the spline overlap limits this range), thus making a redesign to change the first and/or second distances much easier.

Lastly, this arrangement allows for a good adaptation to compression of the rock mass. This is accomplished by the large range of sliding motion provided by the overlapping arrangement set out above. By contrast, the prior art device set out above is limited in the range of motion by the overlapping spline length. Indeed, the axial coupling need not form a break in any of the stems (contrast with the prior art device set out above). Instead, the present device removes the axial coupling section from the anchor stem and provides a collapsing ability to compensate for rock mass deformation above the load application point.

Similarly, the intermediate stem doesn't overlap the tapered section in an initial configuration. Instead, the limited range of axial motion can be used to slide the inner stem proximally relative to the intermediate stem, causing the fingers to flare out. The intermediate section is sized and shaped to fit within the outer stem, and outside the inner stem.

The diameter of the widest part of the tapered section is wider than the inner diameter of the intermediate stem, and the narrowest section of the tapered section is no wider than the inner diameter of the intermediate stem.

The tapered section may be frustoconical or frustopyramidal in shape. The conical or pyramidal portion of the tapered section is oriented with its narrowest portion at the proximal end and the widest portion at the distal end.

The shape of the cutter determines the shape of the hole drilled in the substrate. In some cases, the cutter extends across the entire width of the inner stem, which causes a cylindrical hole to be drilled into the substrate. In other examples, the cutter has an annular shape, which causes an annular hole to be drilled into the substrate. In other words, the hole, once drilled, is a cylindrical hole with a pillar of uncut substrate extending up the centre of the cylindrical hole. Where an annular hole is drilled, the inner stem comprises a lumen for accommodating the pillar of uncut substrate which remains in the hole. The lumen may be central or indeed offset from the central axis, so long as it aligns with the hole (i.e. non-cutting portion) in the cutter. This helps drill holes in substrates smoothly as debris can be flushed out. In some examples, a lumen may be provided in one of the other stems.

This annular geometry allows drilling face speeds (the relative speed between the cutter and the substrate) to be high everywhere, compared with a circular drill face, in which the centre has (in theory) no tangential rotational velocity. Higher drilling speeds allow the drilling to progress more quickly. In these designs, the inner diameter of the cutter (equivalent to the diameter of the pillar of uncut substrate which remains in the hole after drilling) is less than the inner diameter of the lumen in the inner stem. This in turn ensures that flushing fluids have passage through the internal part of the fixation device, since it ensures that the pillar fits into the lumen with a gap around it (equal to the difference between the inner diameter of the cutter and the inner diameter of the lumen).

In some examples, the cutter may be a roller cone design, while in others it may comprise cutting materials embedded in a fixed cutting bit. The choice of cutter is made with a view to optimising the cutter with respect to the type of substrate (e.g. rock type, hardness, etc.) intended to be drilled into.

Optionally, the first and/or second releasable coupling(s) is/are located towards the proximal end of the device. Preferably, the coupling is located within the proximal third or even the proximal or top quarter of the device. The terms "proximal" and "top", "upper", "higher", etc. are used interchangeably in this disclosure, since the device is usually driven downwards into a substrate, from the proximal end, leaving the proximal portion uppermost and exposed. The words "distal" and "bottom", "lower", "base", etc. are also used interchangeably for similar reasons. In other words, "towards the proximal end" means no more than 33% or even 25% of the distance along the device from the proximal end of the device. This not only removes any coupling between the nested stems from the maximum load path, but further advantageously placing the couplings nearest the top makes it more likely any damage (which is itself unlikely due to the improved design) can be fixed.

Optionally the relative axial motion between the intermediate and inner stems is restricted to the first distance by a first axial coupling and/or wherein the relative axial motion between the intermediate and outer stems is restricted to the second distance by a second axial coupling. The use of axial couplings provides a convenient way of coupling adjacent stems to one another to allow rotational drive and limited range of axial motion to provide the required features for installing the device in a substrate.

The or each axial coupling may be located towards the proximal end of the device. As above this may mean that the coupling is located no more than 33% or even 25% of the distance along the length of the device from the proximal (i.e. top) end of the device. Once more this both removes any coupling between the nested stems from the maximum load path, and makes it more likely any damage (which is itself unlikely due to the improved design) can be fixed.

Optionally, the or each axial coupling is located in a different axial location from each releasable coupling. This means that any weakness introduced by the axial and/or releasable couplings do not overlap with one another, so preventing a weak spot forming.

Indeed, in some cases, where there are multiple axial couplings, each of the axial couplings may be located in different axial locations from one another to prevent weak spots. Similarly, where there are multiple releasable couplings, each of the releasable couplings may be located in different axial locations from one another to prevent weak spots.

In a similar way, the or each axial coupling may be located a different angular location around the device from each releasable coupling. Indeed, each axial coupling may be angularly spaced around the device from other axial couplings, and/or the releasable couplings may be angularly spaced around the device from other releasable couplings. This also helps to prevent weak spots forming which may be the case where the couplings occur at the same angular location around the device. In particular, angular spacing between the couplings can help improve resilience to lateral loading of the device.

The or each axial coupling may comprise a slot and pin arrangement. For example, the pin may extend away from an inner surface of the outer stem or the intermediate stem, the pin being received in a corresponding slot in the intermediate or inner stem respectively. Alternatively, the pin may extend away from an outer surface of the inner stem or the intermediate stem, the pin being received in a corresponding slot in the intermediate or outer stem respectively. This provides a convenient and fault tolerant manner for rotationally coupling adjacent stems (inner-intermediate, intermediate-outer), while allowing a degree of axial motion. The length of each slot can be chosen to give the desired range of axial motion. In particular, the slot length determines how long the first and second distances are.

Optionally the or each axial coupling comprises a pair of slots and corresponding pins located on diametrically opposed portions of the device. The exact number and location of slots and pins can be chosen depending on the intended use. However, design considerations may include providing a plurality of slots and pins evenly angularly spaced around the device to ensure that stresses are evenly spread through the device and not focused on a single part, leading to pressure to increase the number of slots. On the other hand, cutting slots into a part removes material and weakens the part, so there is a pressure to reduce the number of slots. Balancing these factors leads to between 2 and 5 slot and pin couplings being a desired number for coupling two adjacent stems. In a preferred example, two slots with corresponding pins has been found to be a good balance between these competing factors, although a single slot and pin arrangement may be preferred in some cases for simplicity.

Where each inter-stem axial coupling (i.e. inner-intermediate and intermediate-outer) is a slot and pin, the diametrically opposed pairs can be rotated 90 degrees with respect to each other, so as to prevent weak points forming, as set out above, as well as to allow them to be sited as close as possible to the proximal end.

In some examples, the slot and pin may be formed from a large annular pin, fit inside an elongate annular void milled into the corresponding surface on the adjacent stem. This has the advantage that the stem with the void milled into it can be continuous, having a section of thinner wall thickness than the main body of the stem, so avoiding the weak point introduced by a slot. The annular pin and annular void can mesh with e.g. a hex profile to allow rotational driving, or they can have a cylindrical profile so as to be rotationally decoupled from one another, which can be useful as it allows the two stems to rotate independently of one another, in cases where such a coupling is desired.

Optionally, the releasable coupling between the inner stem and the intermediate stem and/or the releasable coupling between the intermediate stem and the outer stem comprises a shear pin. Shear pins provide a convenient manner for easily decoupling stems from one another at a predetermined strain. Modern manufacturing techniques allow a very consistent shear strength, so operation can be constrained to the desired shear stresses, allowing a user involved in the installation to determine exactly when in the process the pin should shear. In some cases both releasable couplings comprise shear pins and the shear strength of the shear pin between the intermediate stem and the outer stem has a greater shear strength than a shear strength of the shear pin between the inner stem and the intermediate stem. This allows the same motion to be used to shear both pins, but ensures that the inner-intermediate pin shears prior to the intermediate-outer pin. This has the effect that the relative axial motion between the inner and intermediate stems along the first distance is possible prior to the relative axial motion between the intermediate and outer stems along the second distance being possible. As explained in more detail below, this means that the fingers can be made to flare and undercut the substrate, prior to tensioning the installed device.

In some cases the or each releasable coupling comprises a pair of shear pins couplings on diametrically opposed portions of the device. For similar reasons as given above in respect of the axial couplings, there is a pressure to have even distribution of forces, but also not to weaken the stems by drilling too many holes. For this reason, an optimal number of shear pins may be two diametrically opposed, but in some cases, anywhere from 1 to 5 may be advantageous, wherein the shear pins are equally angularly spaced around the device.

Optionally, the first distance is larger than the second distance. This reflects the different roles of the two distances, allowing an undercut to be cut which is large enough to successfully anchor the device (which is determined by the first distance). The compression of the rock mass is expected to require less movement, so the second distance (which allows for such compression) can be made correspondingly shorter than the first distance.

The first distance is optionally at least as long as a longest cutting finger. In many cases the cutting fingers are all the same length, but in some cases they may have different lengths. The cutting fingers usually start in a position where no part of any of them is axially aligned with the tapered section, so that they can lie flush against the outer surface of the inner stem. Where they have different lengths, this means that the longest cutting finger may lie only as far forward as the proximal end of the tapered section, and any shorter fingers will not extend this far. Consequently, unless the first distance is at least as long as the longest finger, then none of the fingers will be forced fully over the tapered section to flare out to their full extend, thus reducing the undercut.

Optionally the portion for retaining the fixation device in the substrate comprises a portion which tapers from its proximal end towards its distal end. That is, the tapering portion results in the proximal end of the outer stem being wider than its more distal regions. This provides a simple means of gripping the substrate, by wedging the substrate between the fingers and the tapered portion of the outer stem. The taper on the stem can advantageously be shaped to as to exert lateral (i.e. radially outward) pressure on the hole in the substrate. In other examples a capping plate may be used to press against the substrate surface and grip the substrate between the plate and the fingers. This may be useful in cases where the substrate is soft or has structural defects, so that the compressive load is better applied in a distributed manner.

Optionally the flareable cutting fingers are hingedly attached to the distal end of the intermediate stem. This allows the fingers to easily splay out when the inner stem is drawn upwards relative to the intermediate stem. In other cases, the inner stem may extend continuously to become the fingers, and the flareability of the fingers is provided by a thinned portion of the intermediate stem, such that the thinning provides a preferential place for the intermediate stem to deform to allow the fingers to flare out. In other words the flareable fingers may form part of the distal end of the intermediate stem. The portion of the intermediate stem corresponding to the flareable fingers may be coupled to a main body of the intermediate stem via a portion of the intermediate stem which is thinner than the main body of the intermediate stem.

The fingers are generally planar in some embodiments. In others, they may have a wedge shaped profile to be thicker in some regions than in others. This can help the fingers to flare out more widely and ream out a larger undercut than would be possible for planar fingers. Doing so typically requires that the thinnest end of the tapered section is yet thinner (to accommodate the thickest part of the finger), so removing strength from the inner stem.

In some cases of the second example, the outer stem has a driving portion for coupling to a rotational drive and the inner stem has a tensioning nut located proximally of the driving portion for adjusting the relative axial positions of the inner and outer stems, the tensioning nut being located on the inner stem and adjustable by coupling to a rotational drive; and wherein the tensioning nut and the driving portion are configured to couple to the same rotational drive.

That is to say, each of the driving portion and the hex nut can be driven by the same rotational torque to actuate them. The outer stem has a profile for being gripped by a rotational device to rotate the device (that is, the entire device, due to the rotational coupling between the stems) to drill into the sea bed. The tensioning nut is moveable under a rotational action along the inner stem (which can be threaded at its proximal end), where it bears against the protruding part of the outer stem and forces relative movement to grip the rock.

In other examples, a hex nut is not essential, and a square, triangular, etc. profiled coupling may be used. Indeed any regular polygon is possible. The greater the number of faces, the less purchase is possible for driving the profile (as the limiting case is a circle). Conversely, fewer faces leads to problems forming the driving portion from an outer stem, as the wall thickness of the outer stem limits the shape which can be formed because smaller numbers of faces deviate too much from a circle to allow it to be easily milled from a relatively thin wall thickness. For these reasons, the hex profile is preferred because it balances these two conflicting pressures, but the skilled person will appreciate that the fixation device disclosed herein would work with driving portion having any profile so long as it matches the profile of the tensioning nut.

As noted above, the use of a single drive for this purpose vastly simplifies the installation procedure. Compare with the prior art device described above which uses separate drives for the tensioning and drilling phases. An example of a suitable coupling is a hex drive system, as this allows the couplings to be coupled and decoupled from the drive with a simple axial motion. Of course other shapes and types of drive are also possible.

Optionally, the driving portion is spaced in a distal direction from the proximal end of the outer stem. This provides some tolerance in the dual drive ability, in the sense that the tensioning nut can be fully retained in the hex drive, while the driving portion is released. The gap allows there to be a region in which the end of the hex drive is clear of the driving portion but still overlaps a part of the outer stem, thus ensuring that the tensioning nut is definitely still retained.

Optionally the proximal end of the outer stem is narrower than the driving portion. This ensures that the outer stem is not driven by (and indeed does not interact with at all) the hex drive when the driving portion has been disengaged.

The inner stem of either the first or second examples may comprise a lumen for flushing a hole drilled by the cutter. The lumen may be central or indeed offset from the central axis. In addition to the uses in the case of annular holes being drilled as described above, lumens can help in all designs (cylindrical or annular holes) to drill holes in substrates smoothly as debris can be flushed out. In some examples, a lumen may be provided in one or more of the other stems. In addition, flush channels may be present on the outer surface of the outer stem to allow the flushing fluid and debris to exit the hole as it is being flushed.

In addition, the inner lumen may be used to supply grout or other hardenable materials to the hole so that the fixation device can be fixed in place in a solid mass, thereby inhibiting motion of the fixation device within the hole.

The fixation device may further have an attachment point located towards a proximal end of the device. The attachment point may be located on the outer stem. This can help to reduce the complexity of the device. The attachment point may be rotationally coupled to the device, in the sense that the attachment point is rotationally coupled to the device to rotate around a central axis of the device. This means that when a load (e.g. mooring line connected to a floating object) is connected to the device, that load need not be aligned with the attachment point on the device, as the attachment point can simply rotate to align with the load. Not only does this reduce installation costs, but where e.g. a boat is moored to the device currents and tides may cause the direction of the boat relative to the device to change. Where the attachment point is rotatable, the device automatically adapts to such loads. Of course in some cases, there may be multiple attachment points on the device.

The attachment point is provided for coupling mooring lines, cables, chains, etc. to the device. In turn, these mooring lines, cables or chains can be coupled to boats, FPSOs, rigs, turbine assemblies etc. to moor them to the water bed. The attachment point is therefore located on the device above an expected location of substrate when installed. In other words, the location of the attachment point determines the depth to which the device can be drilled, as the device should not be drilled so far into the substrate that the attachment point is below the surface of the substrate as this will impede anchoring mooring lines to the device, thus reducing its usefulness.

In yet further examples, the fixation device may additionally or alternatively comprise a structural connection portion for providing a location on which to construct an underwater structure. In other words, the fixation device may include features on the portion intended to extend above the substrate for connecting or constructing underwater structures on or near the portion of the substrate in which the fixation device is anchored. As an example, a structure may be anchored to the water bed, such that corners of the structure are coupled to the fixation device, thereby holding the structure in place on the water bed.

Also disclosed herein is a remotely operated drive system for installing the fixation devices described above (for examples in which a driving portion and a tensioning nut are provided), the remotely operated drive system comprising: a rotational drive; a first connection rotationally driven by the rotational drive for rotationally driving both the outer stem of the fixation device and the tensioning nut; a second connection for coupling to the inner stem of the anchor; a first axial drive for axial movement of the first connection to decouple it from the outer stem while retaining the tensioning nut; and a second axial drive for axial movement of the inner stem relative to the intermediate stem. This remotely operated drive system is arranged to interact with the fixation device and drive the fixation device into the ground. The rotational drive and the two axial drives are provided specifically to couple to the fixation device set out above, and drive the various parts in the intended manner to install the fixation device in a substrate.

In some examples, the second axial drive may also be rotationally driven. For example, using a second rotational drive, or by coupling the second axial drive to the rotation drive which drives the first connection. This latter case allows a great simplification in the remotely operated drive system, as fewer rotational drives are required to drive both the inner and outer stems. The coupling between the rotational drive and the second connection can simply be made in a fixed manner, or with a clutch and/or brake system, to allow selective decoupling of the inner stem for cases where the inner stem is intended to rotate relative to the other stems (or vice versa).

Optionally, the remotely operated drive system further comprises pumping means for flushing a hole drilled by the cutter. Optionally, the remotely operated drive system further comprises a store of fluid for flushing the hole. These may be connected to a central lumen of the inner stem, to supply the flushing fluid to the lower (distal) end of the fixation device and flush the hole as it is being drilled. The remotely operated drive system may further (or alternatively) include a supply of grout or other hardenable material, for grouting the hole (that is, filling the hole with grout) and thereby fixing the fixation device in a solid mass once the hardenable material has hardened.

Of course, suitable examples of the fixation devices described above may be combined into a single assembly with the remotely operated anchoring system described above, which is also disclosed herein. Specifically this arrangement provides an anchoring installation system comprising the fixation device described above and the remotely operated drive system described above, wherein: the first connection is coupled to the tensioning nut and the driving portion; and the second connection is coupled to the inner stem.

Optionally, the first axial drive is in a deployed position, in which the first axial drive is extended in the distal direction. Additionally or alternatively, the second axial drive may be in a retracted position, in which the second axial drive is retracted and is arranged in a most distal arrangement.

Of course, this arrangement can be thought of as the fixation device described above, further comprising the remotely operated anchoring system also described above, and connected to the fixation device. Alternatively this may be viewed as the remotely operated anchoring system further comprising the fixation device connected to the remotely operated anchoring system. Coupling together the fixation device and the remotely operated anchoring system may be performed before arrival at an installation site, for example on a ship or even on a dock prior to setting out. This allows an installation team to ensure that the various connections are correctly made and to test that the various drives and actuators are operating correctly in a safe and convenient environment.

The first axial drive may be arranged to provide an axial actuation distance equal to at least a the axial extent of the driving portion on the outer stem, to allow the driving portion to be optionally decoupled from the drive system by actuation of the first axial drive. Note that the fixation device is designed specifically for use with the improved drive system set out herein. The driving portion and tensioning nut are arranged such that the first connection can couple to both the tensioning nut and the driving portion, and drive them both together. However, actuation of the first axial drive causes an axial motion of the first connection, decoupling the driving portion but retaining the tensioning nut. This is achieved by placing the tensioning nut in a more proximal region than the driving portion, so as to allow the first axial drive to move away from the fixation device to decouple the driving portion but not the tensioning nut. This is desirable as normal installation of the fixation device does not require driving the outer stem independently of the tensioning nut, yet the tensioning step is performed by rotating the tensioning nut without driving the driving portion.

Also disclosed herein is a method of installing into a substrate suitable examples of the fixation devices described above, the method comprising the steps of: rotationally driving the driving portion of the outer stem and the tensioning nut with a single rotational drive to cause the outer, intermediate and inner stems to rotate due to their rotational coupling, wherein the rotations of the inner stem causes the cutter to drill into a substrate; drawing the inner stem in a proximal direction relative to the intermediate stem while rotationally driving the intermediate stem, to cause the fingers to flare out and ream an undercut in the substrate; decoupling the rotational drive from the outer stem while retaining the tensioning nut in the rotational drive; and driving the tensioning nut in a distal direction relative to the outer stem. The use of a single drive to couple to the driving portion of the outer stem and the tensioning nut greatly simplifies the installation method, since it does not need a complete decoupling of the drive and replacing it with a different drive to continue the installation process, as would be the case if the driving portion of the outer stem and the tensioning nut were not driveable with the same rotational drive.

Optionally, the method is performed using the remotely operated drive system described above. As noted above, the remotely operated drive system described above is specifically adapted to install the fixation devices described herein.

Optionally, the drawing step is performed by deploying the second axial drive. Additionally or alternatively the decoupling step may be performed by retracting the first axial drive. This separation of the two axial drives for different purposes allows flexibility in the installation process.

Optionally, prior to performing the method, the remotely operated drive system is coupled to the fixation device. This may be performed on a ship or even on a dock, which allows an installation team to ensure that the various connections are correctly made and to test that the various drives and actuators are operating correctly in a safe and convenient environment.

Optionally, the method further includes a flushing and clearing step performed while the device is drilling and reaming. As noted above, this can ensure that the drilling process is smooth and that debris does not adversely impact the installation process.

The flushing and cleaning step may finish at the end of the drilling process. Once the fixation device is anchored in place, a grouting step may be performed to fill the hole with a hardenable material, and thereby anchor it in place and inhibit motion of the fixation device within the hole.

The method may further include coupling a buoyant device to the fixation device once the fixation device is installed in the substrate. This allows the buoyant device to be moored to the water bed. In cases where a structural connection is provided, the optional additional step may be to construct or install an underwater structure connected to the structural connection.

It should be noted that the various examples set our herein are all interrelated, in the sense that the fixation device and the remotely operated drive system operate like a plurality of interrelated products, in that they are complementary parts, analogous to a plug and socket.

This is because the fixation device and the remotely operated drive system are specifically designed to couple together to improve the installation process.

The invention will now be described by way of non-limiting examples with reference to the Figures, in which.

Figure 1:
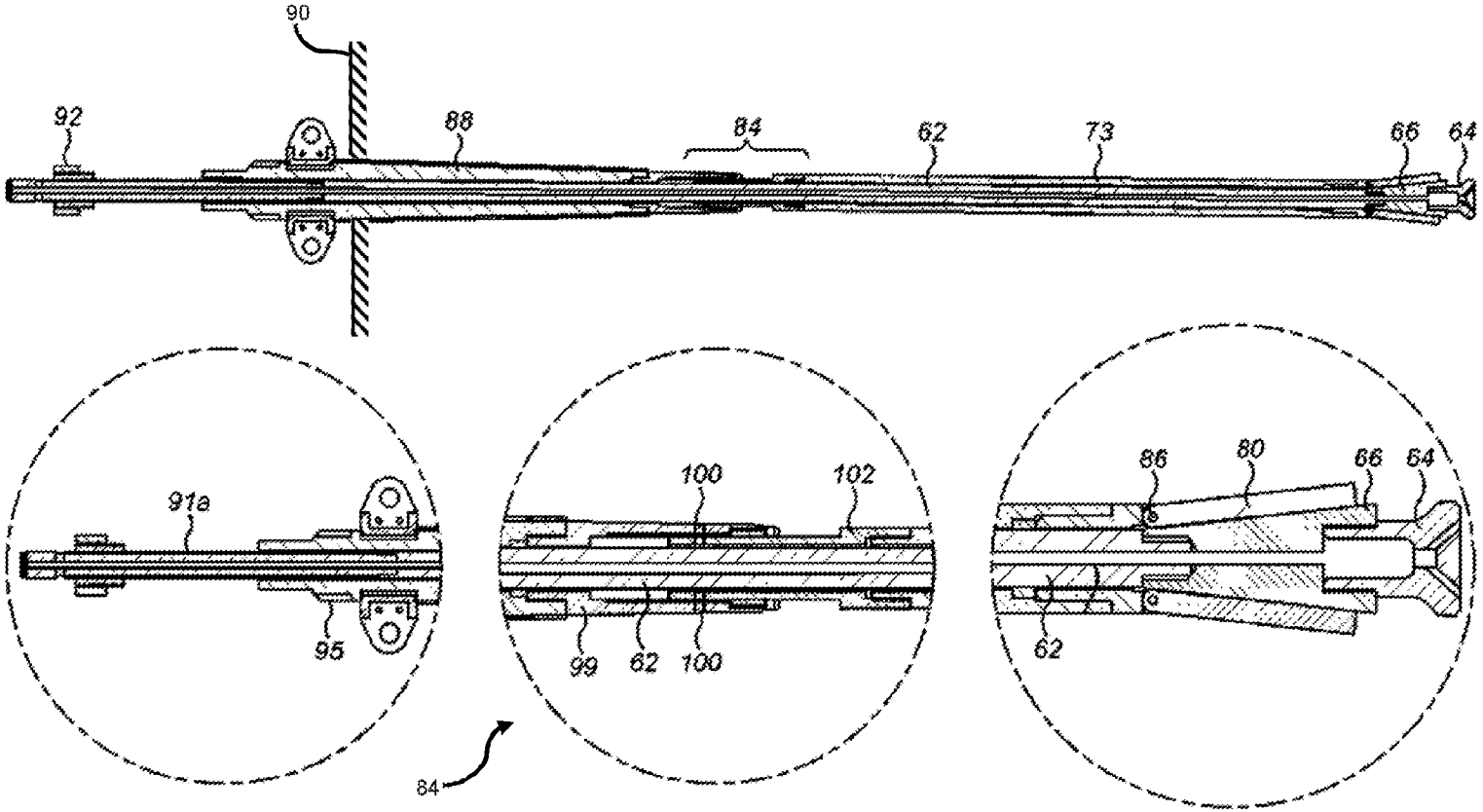
Fig. 1 (Prior Art)
FIG. 1 shows a prior art fixation device.
Figure 2A:
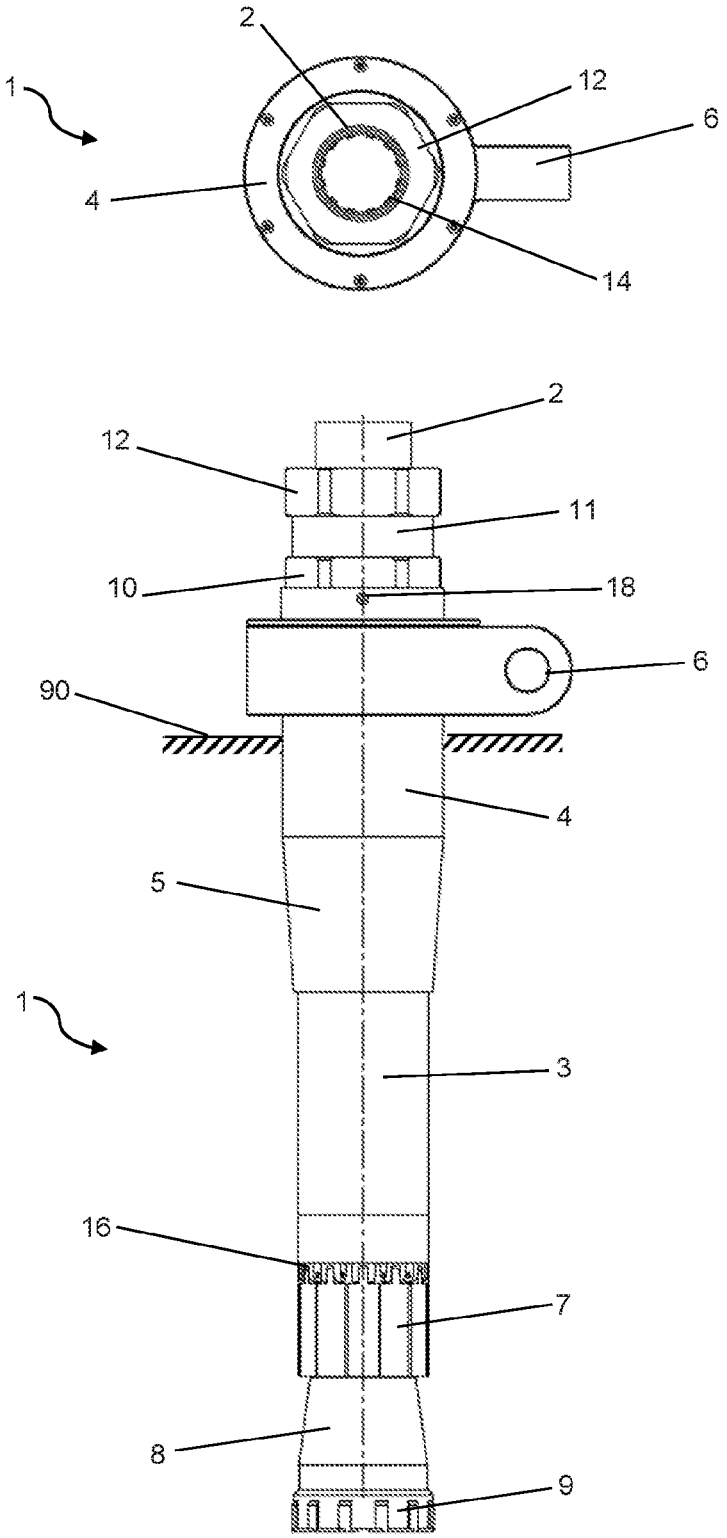
FIG. 2A shows a plan view and side elevation of a fixation device according to the present invention.
Figure 2B:
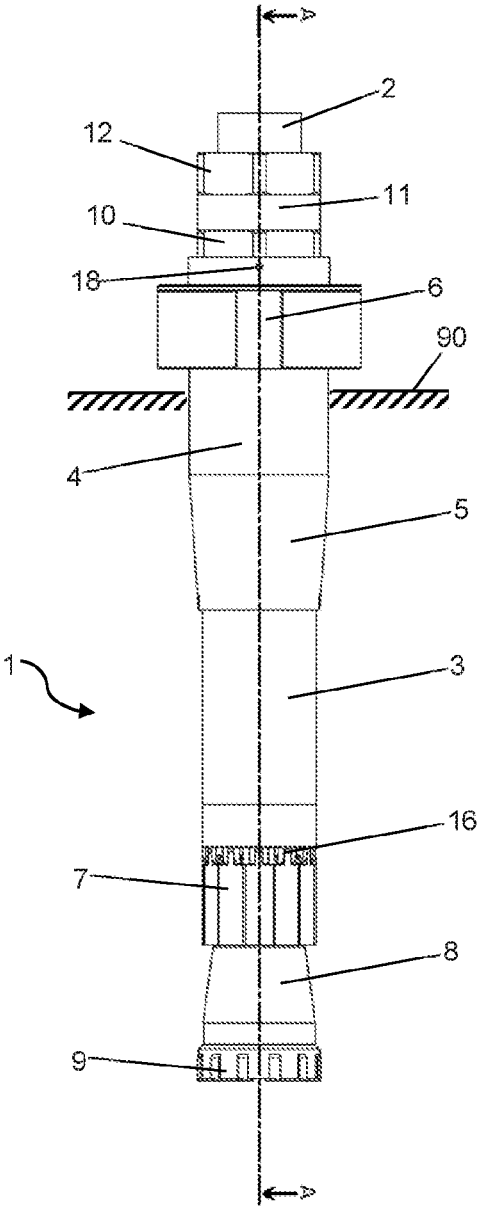
FIG. 2B shows a front elevation of the device of FIG. 2A.
Figure 2C:
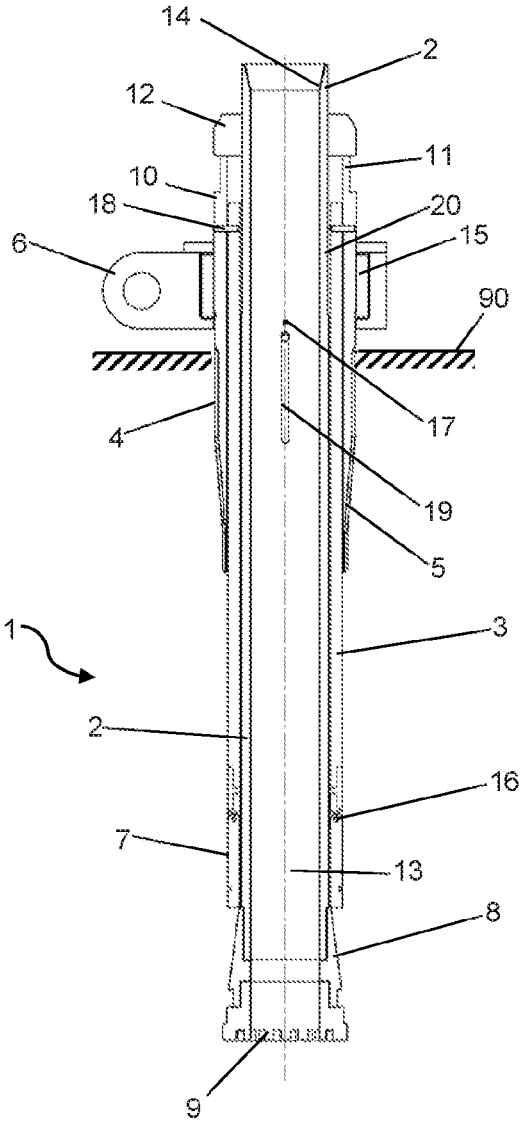
FIG. 2C shows a section through the device of FIGS. 2A and 2B, in the direction of the arrows along the line A-A in FIG. 2B.

In a little more detail, consider FIGS. 2A to 2C. FIG. 2A shows a fixation device 1 from a side elevation at the bottom and a plan view at the top of the Figure. FIG. 2B shows the same device 1 from a front elevation, and FIG. 2C shows the device 1 in sectional view along the line A-A in the direction of the arrows as shown in FIG. 2B. The Figures each show an expected substrate surface position 90, to illustrate the parts of the fixation device 1 which are intended to be anchored within the substrate, and which parts protrude from the substrate. The arrangement of an example of the fixation device 1 will now be described with general reference to these Figures.

An inner stem 2 runs from the top end of the Figure (also referred to as the proximal end), to the bottom end of the Figure (also referred to as the distal end). Towards the lower end, the inner stem 2 has a tapered section 8, which has a frustoconical shape with its narrowest portion located closest to the proximal end of the device 1 (the proximal end of the device is at the top of e.g. FIGS. 2B and 2C). Located distally of the widest (and distal) end of the tapered section 8 is a cutter 9. The cutter 9 comprises teeth or other cutting surfaces for drilling into rock when the inner stem is rotated and driven into a substrate. The cutter may be shaped to improve the drilling action and may include a particularly durable material so as to optimise the cutting effect; for example, tungsten carbide, silicon carbide, artificial diamond, toughened steels, etc. may be suitable materials. A tensioning nut 12 is mounted to the inner stem 2 by way of a screw thread. The inner stem has a central lumen 13 which can be used to flush debris from the hole formed during the drilling process. An upper end of the inner stem 2 has a coupling 14 for attaching to an installation device, as described in more detail below. The coupling may allow for transmission of rotational force, transmission of axial force, and/or provision of fluid to the lumen 13 for flushing a hole during drilling. As shown, the cutter 9 is formed of cutting materials embedded in a cutting bit. Other examples may include roller cone type bits instead.

Nested around the inner stem 2 is an intermediate stem 3. The intermediate stem 3 extends along a central portion of the inner stem 2, but leaves the proximal and distal ends of the inner stem 2 uncovered by the intermediate stem 3. At the lower end of the intermediate stem 3 are a plurality of cutting fingers 7, each attached to the intermediate stem 3 by way of a respective hinged connection 16. As above, the fingers may have special cutting portions, shaped to assist in cutting into rock, and including a suitable material such as tungsten carbide, silicon carbide, artificial diamond, toughened steels, etc.

The intermediate stem 3 is arranged so that relative motion between the inner 2 and intermediate 3 stems (specifically where the relative motion causes the inner stem 2 to move upward or proximally relative to the intermediate stem 3) causes the fingers 7 to interact with the tapered section 8 and flare outwards, in order to ream out an undercut in a substrate, as described in more detail below.

As shown, relative motion between the inner 2 and intermediate 3 stems is prevented by virtue of a first shear pin 17 which couples the inner 2 and intermediate 3 stems both rotationally and axially by fitting into corresponding holes on each stem. The first shear pin 17 is configured to shear at a particular force, thereby providing a selective coupling, in that the stems 2,3 remain coupled until a suitable force is applied (e.g. by lifting the inner stem 2 relative to the outer stem 3 and applying the required shear force), thus providing a releasable coupling between the inner 2 and intermediate 3 stems. Once the first shear pin 17 has sheared, the two stems 2,3 remain rotationally coupled but can move over a limited axial range relative to one another by virtue of a first slot and pin arrangement 19. Limiting the axial motion in this way can help prevent overextension of the fingers 7 during the installation process, which can damage them.

Nested around the upper end of the intermediate stem 3 is an outer stem 4. An upper end of the outer stem 3 has a driving portion 10 for coupling to a rotational drive and thereby driving the outer stem 4 to rotate. The driving portion 10 and the tensioning nut 12 are arranged to be driven by the same rotational drive means, as set out in more detail below. Adjacent to the driving portion 10 is a spacing region 11, which is narrower than the driving portion 10, and is arranged not to interact with the rotational drive means. This means that the drive means can overlap the uppermost part of the outer stem 4, without being engaged to rotationally drive the fixation device 1.

The outer stem 4 is coupled to the intermediate stem by virtue of a second shear pin 18. In part this ensures that, as shown, the outer stem 4 drives the intermediate stem 3, which in turn drives the inner stem 2 by virtue of the rotational coupling between each of the stems. As above, the second shear pin 18 can be configured to shear when a predetermined load is applied, thus providing a releasable coupling between the intermediate 3 and outer 4 stems. This decouples the outer 4 and intermediate 3 stems. As above, even when the second shear pin 18 has sheared, relative motion between the outer 4 and intermediate 3 stems is limited to an axial range by a second slot and pin arrangement 20, while retaining the rotational coupling between the outer 4 and intermediate 3 stems. Allowing a limited range of relative axial motion between the outer 4 and intermediate 3 stems helps to adjust the fixation device 1 to compression of the substrate mass during installation.

The outer stem 4 is provided with an attachment point 6 for coupling to mooring lines, cables, chains, etc. In turn these can be connected to assemblies to be moored to the water bed, such as rigs, FPSOs, ships, floating energy production devices, etc. In some examples, a structural connection portion for providing a location on which to construct an underwater structure may be provided in addition to, or instead of, the attachment point. In the example shown, the attachment point is provided on a rotating collar 15, which can rotate about the central axis of the fixation device 1 (shown as a dot-dashed line in FIGS. 2A to 2C). This allows moored assemblies to drift with currents or tides, and still to align with the location of the attachment point 6, which swivels freely to follow the location of the moored assembly. Of course, in some examples the attachment point 6 may not rotate relative to the fixation device 1, but be fixed in place instead.

The outer stem 4 is located primarily around the upper end of the intermediate 3 and inner 2 stems. The outer stem 4 is provided with a tapered portion 5, which narrows towards the lower end of the fixation device 1. This tapered portion 5 helps the device to grip or bear on the substrate as tension is applied to the device via the tensioning nut 12, which when tightened presses downwards against the top of the outer stem 4 while pulling the inner stem 2 upwards. The substrate is gripped and compressed between the tapered portion 5 and the fingers 7 (the fingers 7 being pulled upwards by the tapered section 8 of the inner stem 2 as the inner stem 2 is pulled upwards). In some examples, there may be no tapered portion, and instead the tensioning nut 12 may press against wide plate or indeed a template with feet in the case of a structural connection being provided, which engages with the substrate surface 90 instead.

Each of the stems 2,3,4 is generally tubular and nested in a triply concentric arrangement. They are formed from any suitable material, specifically one which can withstand the tension forces in gripping the substrate as well as the lateral loading caused by coupling assemblies to the attachment point 6. Corrosion resistant stainless steels, anode protected and coated carbon steels all provide the required level of rigidity and resistance to forces, while being resistant to the harsh conditions found underwater, and being available at a suitable cost. This provides a rigid anchoring pile when installed, and can ensure that the pile can be tensioned and can resist lateral loading, compressive loading (supported against excessing bending or buckling by the rock cavity and tensile loads.

Note that the first shear pin 17 and the first slot and pin arrangement 19 are angularly aligned, but axially offset from one another. Similarly, the second shear pin 18 and the second slot and pin arrangement 20 are angularly aligned, but axially offset from one another. Finally, the first and second shear pins 17,18 are angularly and axially offset from one another, as are the first and second slot and pin arrangements 19,20. This can help to prevent weak spots being focused in one place. Of course other arrangements are possible, for example the shear pins 17,18 not being angularly aligned with either slot and pin arrangement 19,20 or each other.

As shown, the shear pins 17,18 are in fact a pair of diametrically opposed shear pins (but are referred to in the singular for simplicity). Similarly, each slot and pin arrangement 19,20 is actually a pair of diametrically opposed pins and corresponding slots, but is referred to in the singular for simplicity. These arrangements help to ensure that the transmission of rotation between adjacent stems 2,3,4 is smooth and does not focus strain on any one part of the device. In some examples there are different numbers of shear pins 17,18 and slot/pin arrangements 19,20 coupling adjacent stems 2,3,4.

The fixation device 1 in some examples may be around 1.5 m to 2.5 m long in total and 0.25 m to 0.5 m across the outer diameter of the outer stem 4 (not including any attachment points or structural connection portions).

Figure 3A:
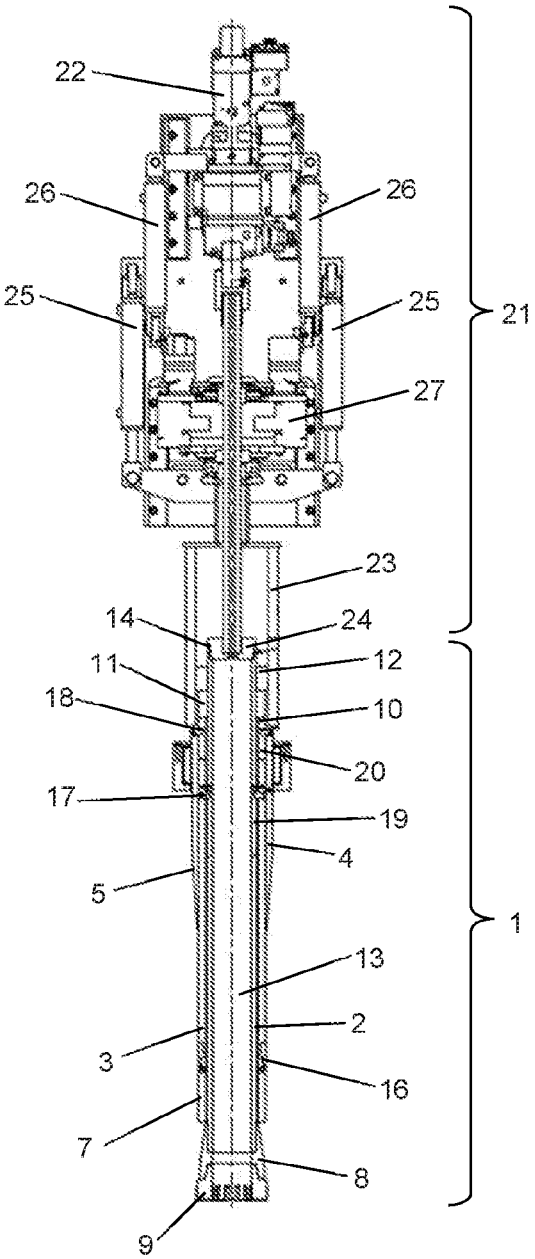
FIG. 3A shows a sectional view of the fixation device of FIGS. 2A to 2C, and an installation rig, prior to installation in a substrate.

Moving on to FIGS. 3A to 3D, the installation of this fixation device will now be described. FIG. 3A shows the fixation device 1 prior to installation, but coupled to a remotely operated installation device 21. The installation device has an upper rotational drive 22 and a lower rotational drive 27 for supplying rotational motions to the fixation device 1, and also two axial drives 25, 26. A first axial drive 25 allows a rotational drive coupling 23 (sometimes referred to as a first connection driven by the rotational drive 22) on the installation device 21 to be moved in an axial direction, for decoupling the rotational drive coupling 23 on the installation device 21 from the driving portion 10 on the fixation device. The second axial drive 26 is coupled to a connection 24 for coupling to the inner stem connection 14, and allows the inner stem to be pulled upwards in the installation procedure. Both sets of axial drives 25,26 are shown as hydraulic rams in this example, but any suitable means could be used, such as pneumatic systems, rack and pinion systems, etc.

The fixation device 1 and the installation device 21 may be coupled together as shown in FIG. 3A before arrival at the installation site. For example, the coupling may occur on dry land (e.g. on a dock prior to loading onto an installation vessel) or it may occur on an installation vessel itself. Doing so can allow operators to test the functionality of the installation device 21, for example to check that the various rotational and axial actuators are operational and able to move throughout their full range of motion. In any case, once the coupling and testing is complete, the fixation device 1 and installation device 21 are lowered to the water bed in the arrangement shown in FIG. 3A to commence installation.

In this pre-installation configuration, the fixation device is in the arrangement shown in FIGS. 2A to 2C, and specifically with the fingers 7 flat against the outer surface of the inner stem 2, the shear pins 17,18 intact (with no relative axial or rotational motion possible between any of the stems 2,3,4). The driving portion 10 and the tensioning nut 12 of the fixation device 1 are engaged by the rotational drive coupling 23 of the installation device 21. In this example, each of the driving portion 10, the rotational drive coupling 23 and the tensioning nut 12 are all hex connections. The rotational drive coupling 23 of the installation device 21 is coupled to a rotational drive 22 (e.g. a hydraulic or electric motor), for providing torque to the fixation device 1. In some cases, the upper rotational drive 22 is simply a clutch/brake arrangement, meaning that only a single drive (the lower rotational drive 27) is used to supply rotational motion to the fixation device 1. In other arrangements the upper drive 22 is the primary drive with the lower drive 27 being coupled to it by a clutch/brake arrangement. The following discussion is framed from the point of view of the upper drive 22 being dominant, but the skilled person will recognise that the same considerations would apply to one in which the lower drive 27 is dominant.

In addition, the inner stem coupling 14 is coupled to an inner stem coupling 24 on the installation device 21. This coupling allows the installation device 21 to impart an axial motion to the inner stem 2. It may also allow rotational motions to be imparted to the inner stem 2, and/or provide fluid for flushing holes drilled by the inner stem 2.

The installation device 21 starts with the first axial drive 25 deployed, that is, extended in a downward (distal) direction. This forces the rotational drive coupling 23 on the installation device 21 to be towards its lowest extent. The rotational drive coupling 23 on the installation device 21 is coupled to both the driving portion 10 on the fixation device 1, and can be retracted (as it begins in a deployed or extended configuration) to decouple from the driving portion 10 on the fixation device 1 as will be seen later).

The position of the first axial drive 25 corresponds with the relative axial arrangement of the inner 2 and intermediate 3 stems relative to one another (and held there by the unbroken first shear pin 17). In more detail, the inner stem 2 is held in its most distal (downward) position relative to the intermediate stem 3, as limited by the first slot and pin arrangement 19. This means that when the first shear pin 17 breaks, the inner stem 2 can move only in the proximal (upward) direction relative to the intermediate stem 3 for up to the first axial distance. This corresponds with the first axial drive being 25 at its lowest (distal-most, deployed) state, meaning that it can only drive the inner stem 2 in an upward direction.

Relatedly, the outer stem 4 is held at its uppermost (most proximal) position relative to the intermediate stem 3 by the unbroken second shear pin 18, as limited by the second slot and pin arrangement 20. When the second shear pin 18 breaks, the outer stem 4 can only move in a downward (distal) direction relative to the intermediate 3 stem (as well as relative to the inner stem 2). This allows the outer stem 4 and its tapered portion 5 and the fingers 7 (and inner stem 2,8) to grip and compress the substrate once installed.

The second axial drive 26 starts the process retracted, that is, also in its lowest or most distal arrangement, meaning that when deployed it moves in an axially proximal or upward direction. Once more, this means that the second axial drive 26 is able, when deployed, to lift the inner stem 2 upwards, relative to the rest of the fixation device 1.

When placed on the water bed, the installation device 21 is stabilised to direct the fixation device into the desired area of the water bed. The positioning can be checked using GPS from a surface vessel, for example, where the installation device 21 and fixation device 1 are lowered together to the water bed by a crane, the position of the crane head is a good representation of the position of the fixation device 1. Additionally, the fixation device 1 is arranged to meet the desired area of the water bed at a desired angle. Usually this is approximately directly downwards irrespective of the slope of the substrate forming the water bed, but other angles may be desirable in some cases, for example perpendicular to the local surface, or at an angle to the local surface. The angle at which the fixation device 9 meets the water bed can be altered by changing the pitch and roll of the fixation 1 and installation 21 devices. This can be achieved by providing an installation frame (not shown) which couples to the installation device 21. The orientation of the frame can be adjusted using hydraulic legs on the frame. Alternatively, the fixation device 21 can have an adjustable coupling to the frame, to allow it to change its orientation, while the frame is a simple frame having no moving parts.

At this stage, installation can begin. Initially, rotation of the rotational drive 22 occurs on a high speed gear. This in turn drives the installation device rotational coupling 23, and in turn rotates the outer stem 4 via the fixation device rotational coupling 10. Since all three stems 2,3,4 are rotationally coupled to one another, the entire fixation device 1 rotates. This means in particular that the inner stem 2 is rotating at the same RPM as the tensioning nut 12, so no relative rotation occurs, and the tensioning nut 12 remains in place, rather than moving up or down along the threaded portions of the inner stem 2. The installation device 21 may have a weight of around 5 metric tons in water, which is enough to drive the fixation device into the substrate. By ensuring that the drilling thrust is suitably limited, for example to no more than 1 to 2 metric tons, the torque is effectively transmitted to the fixation device 1.

This process continues until the fixation device 1 has been drilled to its intended depth (see e.g. the example of the location of the substrate surface 90 in FIGS. 2A to 2C). During this drilling process, a flushing medium can be forced down the lumen 13 in the inner stem 2, to clear the hole of drilling debris. There may be a delay at this stage while additional flushing medium is forced down the lumen 13 to allow the hole to be fully cleared before proceeding.

Once drilled to depth, the fixation device 1 is located in a hole in the substrate, having a diameter equal to the diameter of the cutter 9. Since the fingers 7 are flush against the outer surface of the inner stem 2, they fit neatly into the hole drilled by the cutter.

The next step is to continue to supply rotational force to the fixation device 1 via the driving portion 10 and the rotational drive coupling 23 (and optionally to flush the hole through the lumen 13) while pulling up on the inner stem 2. Due to the coupling of the shear pins 17,18, pulling upwards on the inner stem 2 also pulls the intermediate 3 and outer stems 4 upwards. However, since the rotational drive coupling 23 on the installation device 21 is not axially moved in this motion, the distal (lower) end of the rotational drive coupling 23 on the installation device 21 bears against a shoulder on the outer stem 4 at the lower end of the driving portion 10 on the fixation device 1 and prevents the outer stem 4 (and also the intermediate stem 3 via the second shear pin 18) from moving upwards. This places a shear strain across both shear pins 17,18 as the inner stem 2 is pulled upwards relative to the intermediate stem 3 (this movement is possible due to the initial position of the first slot and pin arrangement 19 which permits upward translation of the inner stem 2 relative to the intermediate stem 3). Similarly, because the first shear pin 17 is initially unbroken, the upward axial force is transmitted from the inner stem 2 to the intermediate stem 3, and causes a strain across the second shear pin 18, where the intermediate stem 3 is forced upwards relative to the outer stem 4. This is equivalent to the desired configuration (discussed in more detail below) where the outer stem 4 is forced downwards relative to the intermediate stem 3, and hence the second slot and pin arrangement 20 would allow the intermediate stem 3 to move upward relative to the outer stem 4, but for the unbroken second shear pin 18. Since this relative motion of the outer stem 4 and the intermediate stem 3 is not intended to occur until later in the installation process, the second shear pin 18 has a greater shear strength than the shear strength of the first shear pin 17. This ensures that the relative timing of the motions is provided in the correct order.

Figure 3B:
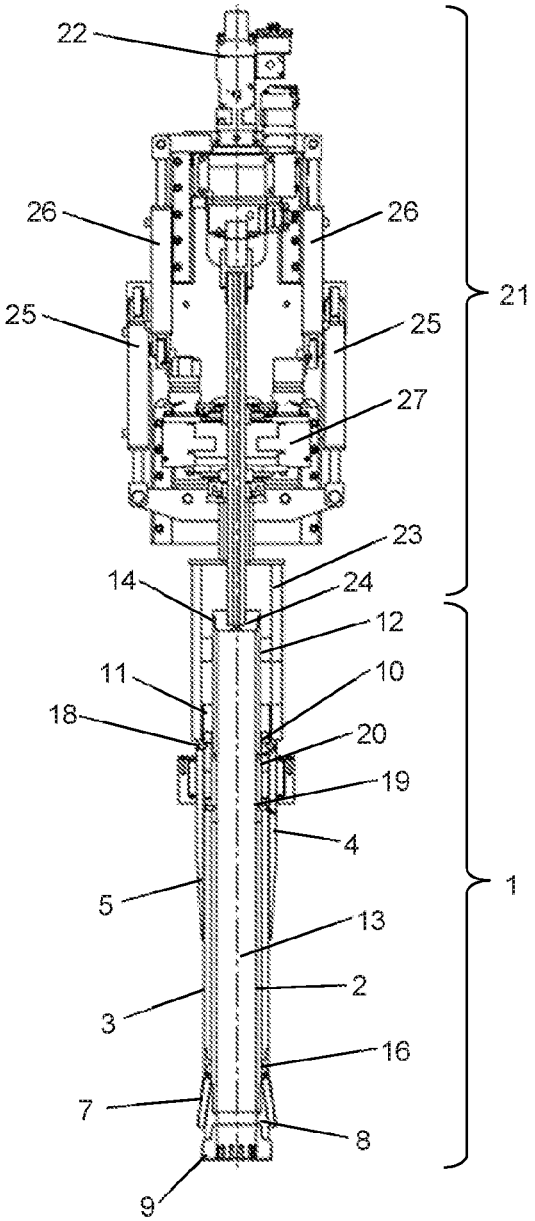
FIG. 3B shows a sectional view of the device of FIGS. 2A to 2C, and an installation rig, at an early stage of installation in a substrate.
Figure 3C:
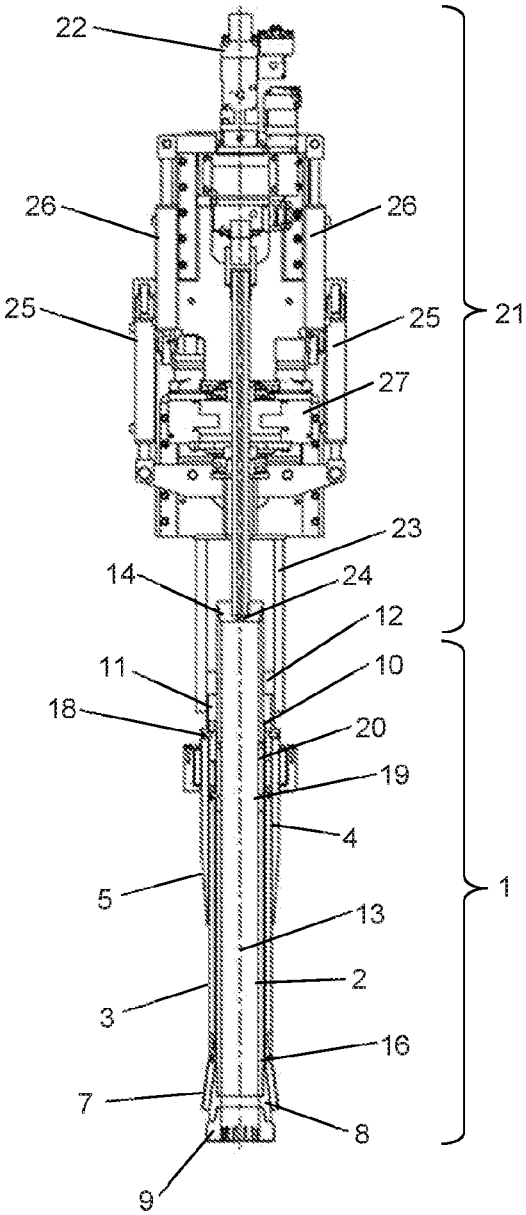
FIG. 3C shows a sectional view of the device of FIGS. 2A to 2C, and an installation rig, at a later stage of installation in a substrate than that shown in FIG. 3B.

The overall result of this motion is to rotate the intermediate stem 3 (indeed, all three stems 2,3,4 are rotating together) while the fingers 7 flare outwards by pivoting around their hinges 16 to their position in FIG. 3B. In some cases, the intermediate stem 3 may be continuous down to the fingers, and instead of hinges 16, a preferentially deformable portion may be provided which is e.g. thinner than the rest of the intermediate stem, to preferentially deform and flare the fingers 7 outwards. As the outermost edges of the fingers 7 flare outwards, they ream out a wider portion of the outer all of the hole drilled into the substrate. When this motion is completed, the hole in the substrate remains largely cylindrical or annular (as described above), with a frustoconical portion towards its lower end. Upward forces on the fixation device 1 will now pull the fingers 7 upwards against the downward-facing surface of the frustoconical portion of the hole, and thus resist the removal of the fixation device 1 from the hole. During this motion, both the driving portion 10 on the fixation device 1 and the tensioning nut 12 are retained in the rotational drive coupling 23 on the installation device 21.

Of course, in some arrangements, the intermediate stem 3 could be forced downwards over the inner stem 2 to flare the fingers with much the same result. However, the arrangement shown in FIGS. 3A to 3D is particularly advantageous as the fact that the inner stem 2 is pulled upwards inside the intermediate stem enables the use of the same drive for both the tensioning nut 12 and the drive coupling 10 because the distal (lower) end of the rotational drive coupling 23 on the installation device 21 bears against a shoulder on the outer stem 4 at the lower end of the rotational drive coupling 10 on the fixation device 1 and prevents the outer stem 2 from moving upwards. Because the rotational drive coupling 23 on the installation device 21 is only required to provide downward axial bracing (i.e. a downward force to prevent upward movement of the outer stem 4) leaves the rotational drive coupling 22 free to lift upwards to easily decouple the rotational drive coupling 10 on the fixation device 1. If instead the rotational drive coupling 23 on the installation device 21 were required to provide an upward bracing force (i.e. to prevent the outer stem 4 moving downwards), for example if the intermediate stem 3 were forced downwards over the inner stem 2, a more complicated drive arrangement would be required, thus complicating the installation procedure. Nonetheless, this may be implemented in some examples. Of course, this arrangement would entail that the starting position of the first axial drive 25 is in its most proximal arrangement (pulled upwards, with the first axial drive 25 deployed) so that the intermediate stem 3 is able to be pushed downward over the inner stem 2 as the first axial drive 25 is retracted. Naturally such an arrangement would require the intermediate stem 3 couples to the installation device 21, to allow the intermediate stem 3 to be pushed, rather than the installation device 21 coupling to the inner stem 2 as in the present example.

Once the fingers 7 are deployed (i.e. have flared out to the intended extent), rotation of the rotational drive 22 is stopped. Once stopped, the first axial drive 25 is actuated to retract it, and pull back the rotational drive coupling 23 on the installation device 21. This disengages the driving portion 10 on the fixation device 1, but retains the tensioning nut 12. This is the situation shown in FIG. 3C.

Figure 3D:
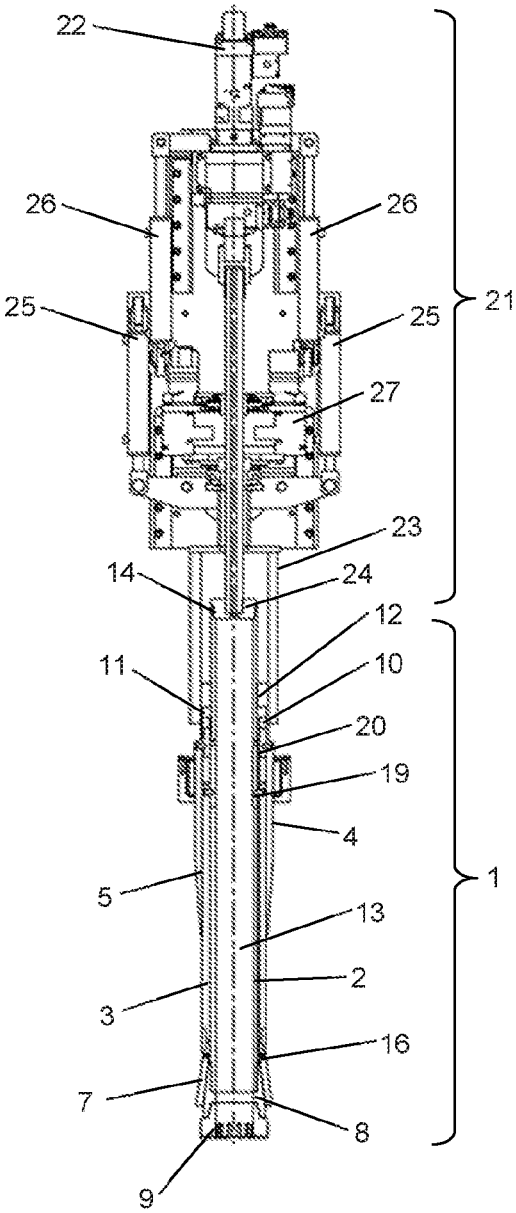
FIG. 3D shows a sectional view of the device of FIGS. 2A to 2C, and an installation rig, with the device installed in a substrate.

The rotational drive coupling 23 on the installation device 21 is then used on a low speed gear to wind the tensioning nut 12 downwards until it bears against the uppermost part 11 of the outer stem 4. In some cases, instead of high/low gearing, a continuously variable speed and torque drive may be used to provide flexibility during the installation process. During this phase, the rotation of the inner stem 2 may be prevented to allow the tensioning nut 12 to be turned relative to the inner stem 2 and thus to travel along the threaded portion of the inner stem 2. The rotational drive coupling 23 on the installation device 21 continues to drive the tensioning nut 12 downwards, increasing the downward force on the outer stem 4. At a predetermined force, the second shear pin 18 shears and allows the outer stem 4 to move downwards relative to the intermediate stem 3 and compress the substrate between the tapered portion 5 and the fingers 7. Note that until the second shear pin 18 shears, the outer stem 4 is stably held in position, so correct positioning of the outer stem 4 into the hole and controlled tensioning of the inner stem 2 and compression of the substrate can be achieved. The compression of the substrate is controlled over a limited axial range by the second slot and pin arrangement 20. Once the compression stage has been completed, the installation device 21 and fixation device 1 are as shown in FIG. 3D. At this stage, the installation device 21 can be decoupled from the fixation device by breaking the connection between the inner stem coupling 14 on the fixation device 1 and the inner stem coupling 24 on the installation device 21. The rotational drive coupling 23 on the installation device 21 simply slides upwardly off the tensioning nut. The installation device 21 can then be retrieved and reused to install subsequent fixation devices of the type described herein. Various mooring couplings (cables, chains, lines, etc.) can be attached to the attachment point 6 on the fixation device 1 to moor assemblies to the water bed. Indeed, although not shown, the fixation device 1 may further or alternatively include a structural connection portion for providing a location on which to construct an underwater structure.

Optionally, the installation device 21 may further supply grout or other hardenable materials to the fixation device 1 via the central lumen 13. The grout can be used to displace water and fill the hole with a hardenable material, which can then harden and hold the fixation device 1 firmly in the hole.

The steps in removal and retrieval of the fixation device 1 from the substrate follow broadly the same steps in reverse. Firstly, any moored assemblies are detached from the fixation device 1. An underwater tensioning device is lowered to the water bed and coupled to the fixation device 1. This tensioning device couples to the inner stem 2 and takes the tension from the inner stem 2. At the same time, the tensioning nut 12 is loosened and driven upwards a distance at least as long as the longest finger 7, in order to allow the fingers 7 to fully collapse. The tensioning device is then removed from the fixation device 1, which allows the inner stem to drop downward (a distance at least as long as the longest finger 7). The fingers 7 are free to act under gravity and hang vertically, flush against the outer surface of the inner stem 2, and thus falling within the outer diameter of the hole.

Lifting apparatus is then attached to the outer stem 4, and an upward force applied. This causes the intermediate stem 3 to hang as low relative to the outer stem 4 as the second slot and pin arrangement 20 will allow. Similarly, the inner stem 2 hangs as low relative to the intermediate stem 3 as the first slot and pin arrangement 19 will allow, thus ensuring that the fingers 7 remain flush against the outer surface of the inner stem 2. This arrangement allows the entire fixation device to be stably lifted out of the hole and removed from the installation site.

The present installation method, as seen in FIGS. 3A to 3D, utilises a single drive to impart torque to the fixation device 1 for drilling. This is in contrast to previous rock anchor technology which requires the use of separated drives for the inner and outer concentric barrels to achieve the control requirements for the anchor installation.

The outer drive in previous anchors is connected via a bayonet type configuration to the fixation device.

In the present disclosure, the single drive is achieved through the use of a hexagonal internal profile on the bore of the rotational drive coupling 23 of the installation device 21, which is sized to match a corresponding external hexagonal profile on both the top of the outer stem 4 and on the tensioning nut 12 as seen in FIGS. 3A to 3D. This configuration allows the pre-tension nut to be captured within the drive when the fixation device 1 is mounted to the installation device 21 above the water's surface at the start of the installation procedure rather than necessitating a breaking of the outer stem 4 connection after drilling, followed by a subsequent stage to align and engage the tensioning nut 12. This represents a significant simplification to the connection between the fixation device 1 and the installation device 21 and therefore significantly simplifies the installation procedure and reduces overall process time.

During drilling the torque is transferred between the triple concentric stems 2,3,4 as required for installation by the slot and pin arrangements 19,20 detailed above.

The invention claimed is:

1. An elongate fixation device for use in subsea anchoring, the fixation device comprising:

an inner stem having a cutter disposed at a distal end and a tapered section located adjacent to and proximally of the cutter;

an intermediate stem having a generally tubular shape and being shorter than the inner stem, the intermediate stem surrounding a central portion of the inner stem and extending distally towards the taper section, wherein the intermediate stem has one or more flareable cutting fingers at its distal end; and an outer stem having a generally tubular shape and a portion for retaining the fixation device in a substrate, the outer stem further having a third length in an axial direction less than the first length, the outer stem surrounding a proximal portion of the intermediate stem and extending proximally beyond a proximal end of the intermediate stem;

a first releasable coupling between the inner and intermediate stems; and a second releasable coupling between the outer and intermediate stems; wherein the inner, intermediate and outer stems are rotationally coupled to one another; wherein the first releasable coupling has a coupled configuration in which relative axial motion between the inner and intermediate stems is prevented and an uncoupled configuration in which relative axial motion between the inner and intermediate stems along a first distance is possible; wherein the second releasable coupling has a coupled configuration in which relative axial motion between the intermediate and outer stems is prevented and an uncoupled configuration in which relative axial motion between the intermediate and outer stems along a second distance is possible; wherein the outer stem has a driving portion for coupling to a rotational drive and the inner stem has a tensioning nut located proximally of the driving portion for adjusting the relative axial positions of the inner and outer stems, the tensioning nut being located on the inner stem and adjustable by coupling to a rotational drive; and wherein the tensioning nut and the driving portion are configured to couple to the same rotational drive.

2. The fixation device according to claim 1, wherein the driving portion is spaced in a distal direction from the proximal end of the outer stem.

3. The fixation device according to claim 1, wherein the proximal end of the outer stem is narrower than the driving portion.

4. The fixation device according to claim 1, wherein the relative axial motion between the intermediate and inner stems is restricted to the first distance by a first axial coupling and/or wherein the relative axial motion between the intermediate and outer stems is restricted to the second distance by a second axial coupling.

5. The fixation device according to claim 4, wherein the or each axial coupling is located in a different axial location along the device and/or a different angular location around the device from each releasable coupling.

6. The fixation device according to claim 1, wherein the releasable coupling between the inner stem and the intermediate stem and/or the releasable coupling between the intermediate stem and the outer stem comprises a shear pin.

7. The fixation device according to claim 6, wherein both releasable couplings comprise shear pins and the shear strength of the shear pin between the intermediate stem and the outer stem has a greater shear strength than a shear strength of the shear pin between the inner stem and the intermediate stem.

8. The fixation device according to claim 1, wherein the portion for retaining the fixation device in the substrate comprises a portion which tapers from its proximal end towards its distal end.

9. The fixation device according to claim 1, wherein the flareable fingers form part of the distal end of the intermediate stem.

10. The fixation device according to claim 9, wherein the portion of the intermediate stem corresponding to the flareable fingers is coupled to a main body of the intermediate stem via a portion of the intermediate stem which is thinner than the main body of the intermediate stem.

11. The fixation device according to claim 1, wherein the first distance is larger than the second distance, optionally wherein the first distance is at least as long as a longest cutting finger.

12. The fixation device according to claim 1, further including a remotely operated drive system for installing the fixation device, the remotely operated drive system comprising:

a rotational drive;

a first connection rotationally driven by the rotational drive for rotationally driving both the outer stem of the fixation device and the tensioning nut;

a second connection for coupling to the inner stem of the anchor;

a first axial drive for axial movement of the first connection to decouple it from the outer stem while retaining the tensioning nut; and a second axial drive for axial movement of the inner stem relative to the intermediate stem; wherein:

the first connection is coupled to the tensioning nut and the driving portion; and the second connection is coupled to the inner stem.

13. The fixation device according to claim 12, wherein the second connection is also rotationally driven by the rotational drive.

14. The fixation device according to claim 12, wherein the first axial drive is in a deployed position, in which the first axial drive is extended in the distal direction.

15. The fixation device according to claim 12, wherein the second axial drive is in a retracted position, in which the second axial drive is retracted and is arranged in a most distal arrangement.

16. A method of installing into a substrate the fixation device according to claim 1, the method comprising the steps of:

rotationally driving the driving portion of the outer stem and the tensioning nut with a single rotational drive to cause the outer, intermediate and inner stems to rotate due to their rotational coupling, wherein the rotations of the inner stem causes the cutter to drill into a substrate;

drawing the inner stem in a proximal direction relative to the intermediate stem while rotationally driving the intermediate stem, to cause the fingers to flare out and ream an undercut in the substrate;

decoupling the rotational drive from the outer stem while retaining the tensioning nut in the rotational drive; and driving the tensioning nut in a distal direction relative to the outer stem.

17. The method according to claim 16, wherein the method is performed using a remotely operated drive system for installing the fixation device, the remotely operated drive system comprising:

a rotational drive;

a first connection rotationally driven by the rotational drive for rotationally driving both the outer stem of the fixation device and the tensioning nut;

a second connection for coupling to the inner stem of the anchor;

a first axial drive for axial movement of the first connection to decouple it from the outer stem while retaining the tensioning nut; and a second axial drive for axial movement of the inner stem relative to the intermediate stem; wherein:

the first connection is couplable to the tensioning nut and the driving portion; and the second connection is couplable to the inner stem.

18. The method according to claim 17, wherein the drawing step is performed by deploying the second axial drive.

19. The method according to claim 17, wherein the decoupling step is performed by retracting the first axial drive.

20. An elongate fixation device for use in subsea anchoring, the fixation device comprising:

an inner stem having a first length in an axial direction, the inner stem having a cutter disposed at a distal end and a tapered section located adjacent to and proximally of the cutter;

an intermediate stem having a generally tubular shape and having a second length in an axial direction less than the first length, the intermediate stem surrounding at least a central portion of the inner stem and extending distally towards the taper section, wherein the intermediate stem has one or more flareable cutting fingers at its distal end;

an outer stem having a generally tubular shape and a portion for retaining the fixation device in a substrate, the outer stem further having a third length in an axial direction less than the first length, the outer stem surrounding a proximal portion of the intermediate stem and extending proximally beyond a proximal end of the intermediate stem;

a first releasable coupling between the inner and intermediate stems; and a second releasable coupling between the outer and intermediate stems; wherein the first releasable coupling has a coupled configuration in which relative axial motion between the inner and intermediate stems is prevented and an uncoupled configuration in which relative axial motion between the inner and intermediate stems along a first distance is possible; wherein the second releasable coupling has a coupled configuration in which relative axial motion between the intermediate and outer stems is prevented and an uncoupled configuration in which relative axial motion between the intermediate and outer stems along a second distance is possible; and wherein the intermediate stem is nested within the outer stem for at least a majority of the outer stem.

* * * * *